US006220482B1

(12) United States Patent
Simmel et al.

(10) Patent No.: US 6,220,482 B1
(45) Date of Patent: Apr. 24, 2001

(54) CONTROLLED PRODUCT DISPENSING SYSTEM

(75) Inventors: Thomas L. Simmel; Craig A. Baker, both of Milford, CT (US)

(73) Assignee: Link Research and Development Inc., Milford, CT (US)

( * ) Notice: Subject to any disclaimer, the term of this patent is extended or adjusted under 35 U.S.C. 154(b) by 0 days.

(21) Appl. No.: 09/521,149

(22) Filed: Mar. 8, 2000

Related U.S. Application Data

(60) Provisional application No. 60/127,915, filed on Apr. 6, 1999.

(51) Int. Cl.[7] ..... B67D 5/00

(52) U.S. Cl. ..... 222/83; 222/89; 222/148; 141/91; 141/329

(58) Field of Search ..... 222/81, 83, 83.5, 222/89, 148; 141/329, 330, 91

(56) References Cited

U.S. PATENT DOCUMENTS 1,324,206 * 12/1919 Nickell ..... 222/83
2,373,373 * 4/1945 Berg ..... 222/83
4,011,288 * 3/1977 Assenheimer et al. ..... 222/83.5
4,081,006 * 3/1978 Crowell et al. ..... 141/330
4,144,901 * 3/1979 Stevenson ..... 222/148
4,805,802 * 2/1989 MacKendirck et al. ..... 222/83
4,884,705 * 12/1989 Debetencourt ..... 222/83
5,229,606 * 7/1993 Schrupp ..... 141/91
5,740,945 * 4/1998 Shipway ..... 222/83
5,875,921 * 3/1999 Osgar et al. ..... 222/83
5,934,509 * 8/1999 Niss ..... 222/83

* cited by examiner

*Primary Examiner*—J. Casimer Jacyna
(74) *Attorney, Agent, or Firm*—Melvin I. Stoltz

(57) ABSTRACT

By providing an adapter which is mountable to a product retaining container and incorporating seal cutting means, a dispensing system for chemical products retained in sealed containers is achieved which is capable of opening the sealed container and producing the transfer of concentrated chemical products from the storage container to a dilution vessel or tank in a completely closed, spill-free manner. Furthermore, the entire contents of the container can be transferred or, if desired, repeated transfer of measured dosage can be made in order to assure the dispensing of a precise quantity of product from the storage container to the dilution vessel. In the preferred embodiment, a product dispensing valve assembly, constructed for being opened by only mating authorized equipment, is securely affixed to the adapter which is mounted to the sealed container within which the desired chemical product is retained. In this way, controlled distribution of the product from the storage vessel is attained and implemented only by authorized personnel using authorized equipment.

14 Claims, 11 Drawing Sheets

CONTROLLED PRODUCT DISPENSING SYSTEM

This application claim benefit to Provisional Application Ser. No. 60/127,915 filed Apr. 6, 1999.

TECHNICAL FIELD

This invention relates to product dispensing systems and, more particularly, to product dispensing systems which provide automatic opening of sealed containers as well as controlled, closed loop transfer of chemicals from the container to a receiving vessel.

BACKGROUND ART

For many years, safe, trouble-free delivery or transferral of various materials, particularly toxic or hazardous materials, has long been a problem which has plagued the industry. In particular, in situations where small quantities of such materials are to be transferred from a storage container to an active, usable reservoir, such as a holding tank wherein the materials are diluted for use, the difficulties typically encountered with transferring these products become most acute.

In an attempt to reduce or eliminate these difficulties, various systems or adaptors have been developed. However, these prior art systems have failed to eliminate or overcome the inherent problems or dangers.

Some of the most acute problems occur with the transferral or dispensing of concentrated chemicals to be added into a diluting solution, typically water, for intermixture therewith and subsequent applications to a particular item or surface. One area in which products of this nature are frequently employed is the agricultural field, which includes commercial and large-scale turf and ornamental applications where grass, plants, and the like are grown for sale or for maintenance. This area also encompasses golf courses, wherein large grass areas must be carefully maintained. However, numerous other areas and industries also require similar systems for the transferral of concentrated chemicals.

In employing these chemical products, extreme care must be exercised due to the concentrated, toxic nature of the fluid materials. In addition, care must be exercised in dispensing these products from a storage vessel to a delivery container or dilution vessel, in order to assure that proper delivery of the concentrated material is achieved, as well as proper dilution and mixing. In many instances, the introduction of excess fluid material into the dilution container can cause an overly concentrated spray to be applied, which can either damage the plants, grass, etc. to which it is applied. In addition, harm to the environment may also result due to the run off of concentrated solutions into ground water supplies.

In an attempt to control the dispensing of these chemicals, product bearing containers have been sealed, requiring the user to physically break the seal prior to use. However, instead of improving difficult distribution problems, sealed containers have caused added problems and increased potential spillages.

In order to open these sealed containers, users typically employ readily accessible instruments, such as knives, screw drivers, and the like, to break the seal and open the container. Then, the chemicals are dispensed into the dilution vessel. Unfortunately, this process exposes the chemical product directly to the individuals, as well as enabling the chemicals to be spilled from the container onto the surrounding area.

As a result, unwanted contact of toxic chemicals with the environment and personnel can and often does occur.

Although the need for carefully measuring and/or dispensing such chemical products from sealed storage containers to the dilution vessel or tank has been well known in the prior art, no system has been developed for successfully, efficiently, and repeatedly delivering any desired quantities of the concentrated chemical material on a repeatable basis in an easily used system. As a result, the quantities being delivered are not accurate and spillage of the products onto the surrounding area often occurs. These inherent problems have consistently caused difficulties and potential harm to the environment as well as to individuals and has caused less effective concentrations to be applied or used.

In addition, another problem that has plagued this industry is the complexity of prior art constructions. Many prior art chemical product transfer systems are formed from numerous components, requiring expensive manufacturing and assembly costs. Consequently, these systems have not been successful.

Therefore, it is a principal object of the present invention to provide a dispensing system for chemical products retained in sealed containers which operates in a completely closed manner using only authorized equipment.

Another object of the present invention is to provide a dispensing system for chemical products retained in sealed containers and having the characteristic features described above which is capable of dispensing the entire contents of a container or measured quantities of the concentrated chemical, assuring the transfer of reasonably precise amounts.

Another object of the present invention is to provide a dispensing system for chemical products retained in sealed containers and having the characteristic features described above which quickly and easily is mounted to the sealed container and automatically opens the seal in a completely closed, spill-free environment.

Another object of the present invention is to provide a dispensing system for chemical products retained in sealed containers having the characteristic features described above which completely eliminates spillage, excessive dosing, and underdosing.

Another object of the present invention is to provide a dispensing system for chemical products retained in sealed containers and having the characteristic features described above which is completely safe and operates in an easily employed, error-free manner.

A further object of the present invention is to provide a dispensing system for chemical products retained in sealed containers and having the characteristic features described above which provides positive, flow control means to assure that the chemical product is delivered only when safe to do so.

Another object of the present invention is to provide a dispensing system for chemical products retained in sealed containers and having the characteristic features described above which employs a minimum of components and is reasonably easy to assemble.

Another object of the present invention is to provide a dispensing system for chemical products retained in sealed containers and having the characteristic features described above which employs cooperating, interlocking components, thereby preventing access to chemicals which are not authorized.

Another object of the present invention is to provide a dispensing system for chemical products retained in sealed containers and having the characteristic features described above which enables empty containers to be rinsed clean as part of the dispensing operation, thereby further enhancing system efficiency and environmental safety.

Other and more specific objects will in part be obvious and will in part appear hereinafter.

SUMMARY OF THE INVENTION

By employing the present invention, all of the difficulties and drawbacks found in the prior art are completely overcome and a dispensing system for chemical products retained in sealed containers is achieved which is capable of opening the sealed container and producing the transfer of concentrated chemical products from the storage container to a dilution vessel or tank in a completely closed, spill-free manner. Furthermore, by employing the present invention, the entire contents of the container can be transferred or, if desired, repeated transfer of measured dosage can be made in order to assure the dispensing of a precise quantity of product from the storage container to the dilution vessel.

In order to attain this controlled container opening and spill-free, dispensing and delivery of any desired chemical product, the present invention employs a product dispensing valve assembly, constructed for being opened by only mating authorized equipment, and is securely affixed to an adapter which is mounted to the sealed container within which the desired chemical product is retained. As discussed above, since such chemical products are often highly concentrated and toxic, the product dispensing valve assembly of the present invention is preferably securely affixed to the adapter in a manner which prevents the removal of the valve assembly from the adapter. In addition, the adapter is preferably constructed for being mounted to the sealed container and locked in place before the cutting means incorporated therein is activated. In this way, controlled distribution of the product from the storage vessel is attained and implemented only by authorized personnel using authorized equipment.

In order to assure the chemical product retained in the sealed storage container is distributed only at the desired times, and is otherwise inaccessible, the container mountable adapter of the present invention incorporates seal cutting means which are easily activated once the mating valve assembly is mounted in place, allowing the sealed container to be opened and the product able to be dispensed through the desired valve assembly. In this way, a controlled product dispensing system is attained as well as limiting the use of the system to only those individuals having authorizing equipment.

In addition, the adapter of the present invention incorporates a rinsing system which enables the product container to be rinsed after the product is dispensed therefrom. In this way, clean containers are assured and the unwanted transfer of concentrations of toxic chemicals is eliminated.

In this embodiment, a water receiving conduit is integrally formed in the adapter for being easily interconnected to a water source for delivering rinse water to the container when desired. In addition, the water receiving conduit is mounted to the adapter in a way which prevents any interference with the flow of the chemical product from the container through the adapter to the dilution vessel. Furthermore, the water delivery conduit incorporates a check valve to prevent passage of the chemical product into the conduit.

In order to assure a closed loop distribution system is achieved which is employed only by authorized individuals, a specialized valve assembly is mounted to the adapter of the present invention. In this regard, the valve assembly comprises closure and locking means which are automatically engaged whenever the product dispensing valve assembly is disengaged from a cooperating coupling member. In addition, the mating, specially constructed coupling member is mounted to the dilution vessel or tank and employed to cooperate with the valve assembly by effectively disengaging the locking means when activated.

In this way, assurance is provided that no individual can obtain unauthorized access to the chemical product stored within the closed and sealed container. Only by employing the proper coupling is one able to disengage the locking means of the product dispensing valve assembly of the present invention, activate the adapter mounted to the sealed container to open the container, and then enable the distribution of the chemical product from the storage container to the dilution vessel.

By achieving a product dispensing valve assembly which is normally securely locked and a cooperating, sealed product container mounted to an adapter employed for rupturing the seal to gain access to the container, a controlled dispensing system is realized which provides complete controlled distribution of the desired chemical product by only authorized personnel and only into suitable vessels incorporating the required coupling member for unlocking the locking means of the valve assembly. As a result, complete control over the distribution of the chemical product is attained, and all of the difficulties and drawbacks found in the prior art are completely overcome and a controlled distribution system capable of satisfying all of the industry needs and expectations is attained.

In the preferred construction of the present invention, the goals and objectives of the present invention are achieved by constructing the adapter of the present invention for being easily mounted to a product container and easily activated to break the seal to gain access to the desired product in a completely closed environment. In achieving this result in one embodiment of the present invention, the adapter comprises an enlarged housing, a container engaging collar movably mounted in the housing, and an elongated, cylindrically shaped tube cooperatively mounted to both the housing and collar and axially movable relative thereto.

In the preferred construction of this embodiment, the housing of the adapter comprises a desired size and shape for cooperating with the sealed product container to which the adapter is to be mounted. In particular, container engaging means are formed in the housing to assure secure engagement of the housing with the container is easily achieved, when desired, to prevent rotation of the adapter relative to the container once the adapter is mounted and locked in place.

In addition to the housing, the adapter of the present invention incorporates a collar which has thread means formed thereon for threaded engagement with the threads of the container. In addition, the collar is preferably axially movable within the housing for enabling the adapter to be mounted to the container and then locked in place by moving the housing relative to the collar. In addition, vertical ridges or locking keys are employed to prevent unwanted rotational movement of the housing relative to the collar once the housing is engaged with the container.

The final principal element forming the adapter is the elongated cylindrically shaped tube which is coaxially mounted with the collar and the housing. In the preferred embodiment, one end of the tube is constructed for mating secure engagement with the valve assembly. In addition, the opposed end of the tube comprises a beveled, terminating end, or similar construction, which establishes seal cutting means thereon. In this way, when the tube is axially moved towards the container seal and brought into contact with the seal, the cutting mens engage and break the seal, opening the container for access to the chemical product contained therein.

In a typical operation, the adapter is either constructed with a valve assembly securely mounted to the cylindrical tube, or has a valve assembly mounted thereto prior to use. Then, the adapter and valve assembly are mounted to a sealed container by threadedly engaging the collar with the threaded portal zone of the container.

In the next step, the housing is axially moved relative to the collar in order to lockingly engage the housing with the container. When in the container locked and engaged position, removal of the collar from the container is prevented.

In the final step, the elongated, cylindrically shaped tube, with the valve assembly mounted thereto, is axially moved into contact with the sealed zone of the container, causing the cutting means to contact and cut the seal. Once axially advanced to its stop position, the cutting means of the tube completely breaks the seal, effectively opening the container. Thereafter, the valve assembly is mounted to the cooperating coupling member on the dilution tank, enabling the product, whether concentrated, toxic, or otherwise, to be dispensed from the container in a completely controlled, closed loop, spill-free manner.

In a second embodiment of the present invention, the adapter is constructed using only the container engaging collar and the elongated, cylindrically shaped tube which is cooperatively mounted to the collar and axially movable relative thereto. In this embodiment, the housing is eliminated. In order to assure that closed, spilled-free dispensing is provided, a valve member is preferably securely affixed to one end of the cylindrically shaped tube member, thereby preventing any product from being dispensed from the container except by authorized personnel using authorized receiving vessels or dilution tanks.

In this embodiment of the present invention, the housing which peripherally surrounds the collar is eliminated, thereby enabling the collar to be directly secured to the product retaining container. In addition, the cylindrically shaped tube member is constructed with a cutting edge for breaking the seal of the product container. In using this embodiment of the present invention, the collar is securely affixed to the desired product retaining container by threadedly engaging the collar with the threaded zone of the container's portal. Then, when desired, the tube member is telescopically co-axially advanced relative to the collar, causing the cutting edge of the tube member to contact and cut in the seal of the container for gaining access to the product retained therein.

In a further aspect of the present invention, the adapter is constructed with a rinsing system for enabling the user to rinse the container once the container is emptied. In accordance with this invention, the container can be rinsed independently of the dilution vessel or, if desired, rinsed while still interconnected with both the container and the dilution vessel, enabling the contents of the container to be emptied into the dilution vessel and rinsed immediately thereafter, without requiring disconnection of the container from the dilution vessel.

Regardless of which method is employed, the adapter incorporates a water engageable conduit which provides the desired water flow through the conduit into the container. Once completely rinsed, the container is disposed of in the normal manner.

In addition, in one embodiment of the present invention, a spray control member is securely mountable to the cylindrically shaped tube member for controlling the flow of the water from a water source directly into the tube member and the container to be cleaned. In addition, in this embodiment, a flow path is provided in the tube member which provides the optimum positioning and optimum delivery of the water flow to obtain complete cleaning of the container once the product retained therein has been dispensed.

In this preferred construction, the spray control member comprises a trigger assembly which enables water flow to be quickly and easily activated and de-activated when desired. In addition, the control member is preferably constructed for being quickly and easily mounted to the tube member for assuring ease of use and actuation.

The invention accordingly comprises an article of manufacture possessing the features, properties, and the relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which.

DETAILED DESCRIPTION

Figure 1:
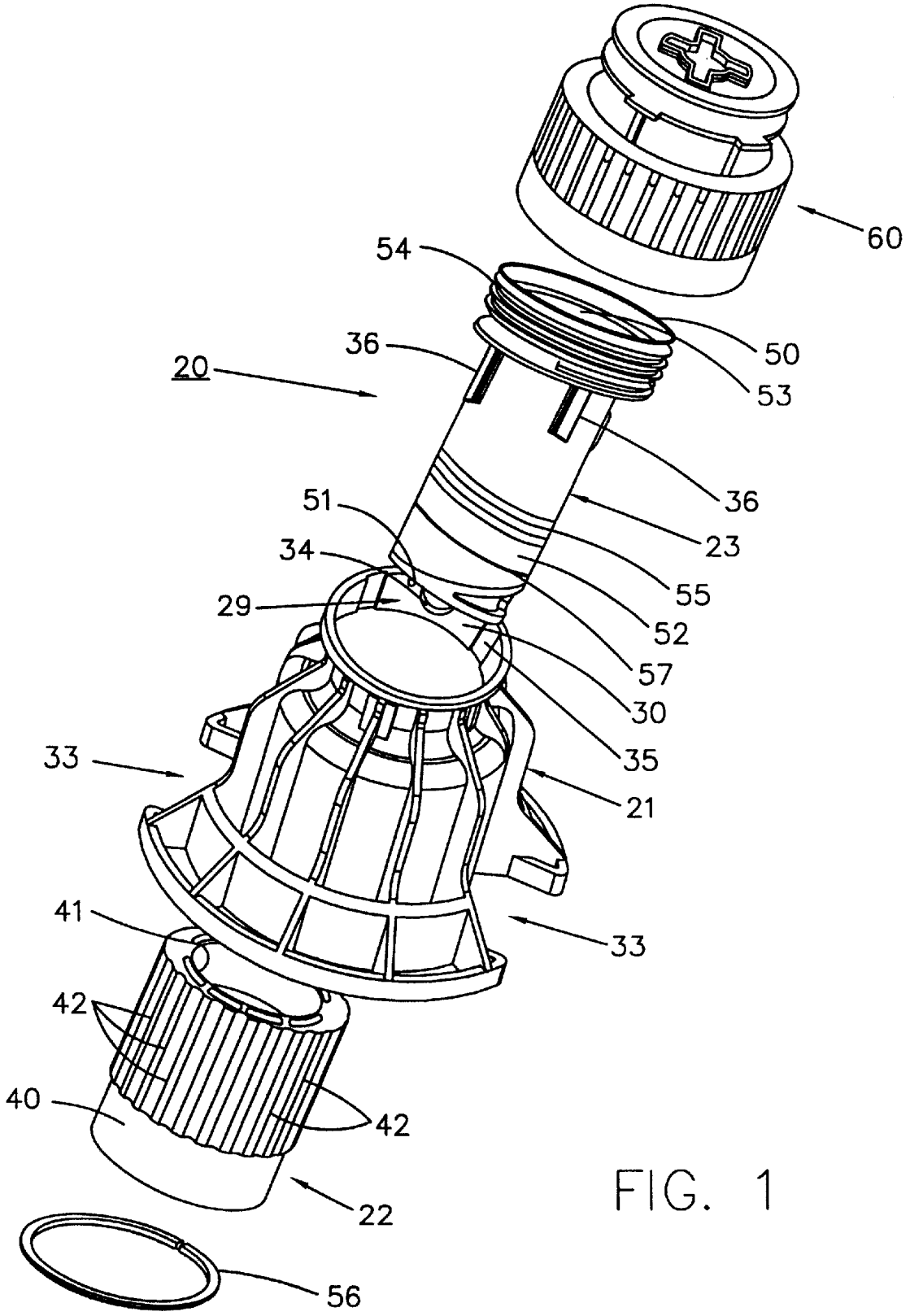
FIG. 1 is an exploded perspective view of one embodiment of the adapter and dispensing system of the present invention.

By referring to FIGS. 1–11, along with the following detailed disclosure, the construction and operation of two alternate preferred embodiments of the present invention can best be understood. Although the preferred constructions are fully detailed herein, the present invention may be implemented further using alternate embodiments. Consequently, it is to be understood that the embodiments shown in the Figures and discussed herein are provided for exemplary purposes only and are not intended as a limitation of the present invention.

In FIGS. 1–8, the overall construction of one preferred embodiment of adapter 20 of the present invention is clearly seen. In this embodiment, adapter 20 comprises housing 21, collar 22, and elongated cylindrically shaped tube 23. In addition, adapter 20 also comprises water delivery conduit 24 securely mounted to tube 23 for delivering water to the interior of tube 23 and the container mounted therewith for rinsing the container when desired.

In addition, as shown in FIGS. 1 and 6–8, valve member 60 is preferably securely mounted to one end of cylindrically shaped tube 23 in order to control the flow of the product from the container, once opened. By employing valve member 60 with adapter 20, a unique, closed, spill-free dispensing system is realized.

Furthermore, although tube 23 is shown and described as comprising a cylindrical shape, tube 23 may comprise any desired alternate cross-sectional shape or configuration. As detailed herein, the only requirement is that tube member 23 be telescopically movable relative to collar 22.

Figure 6:
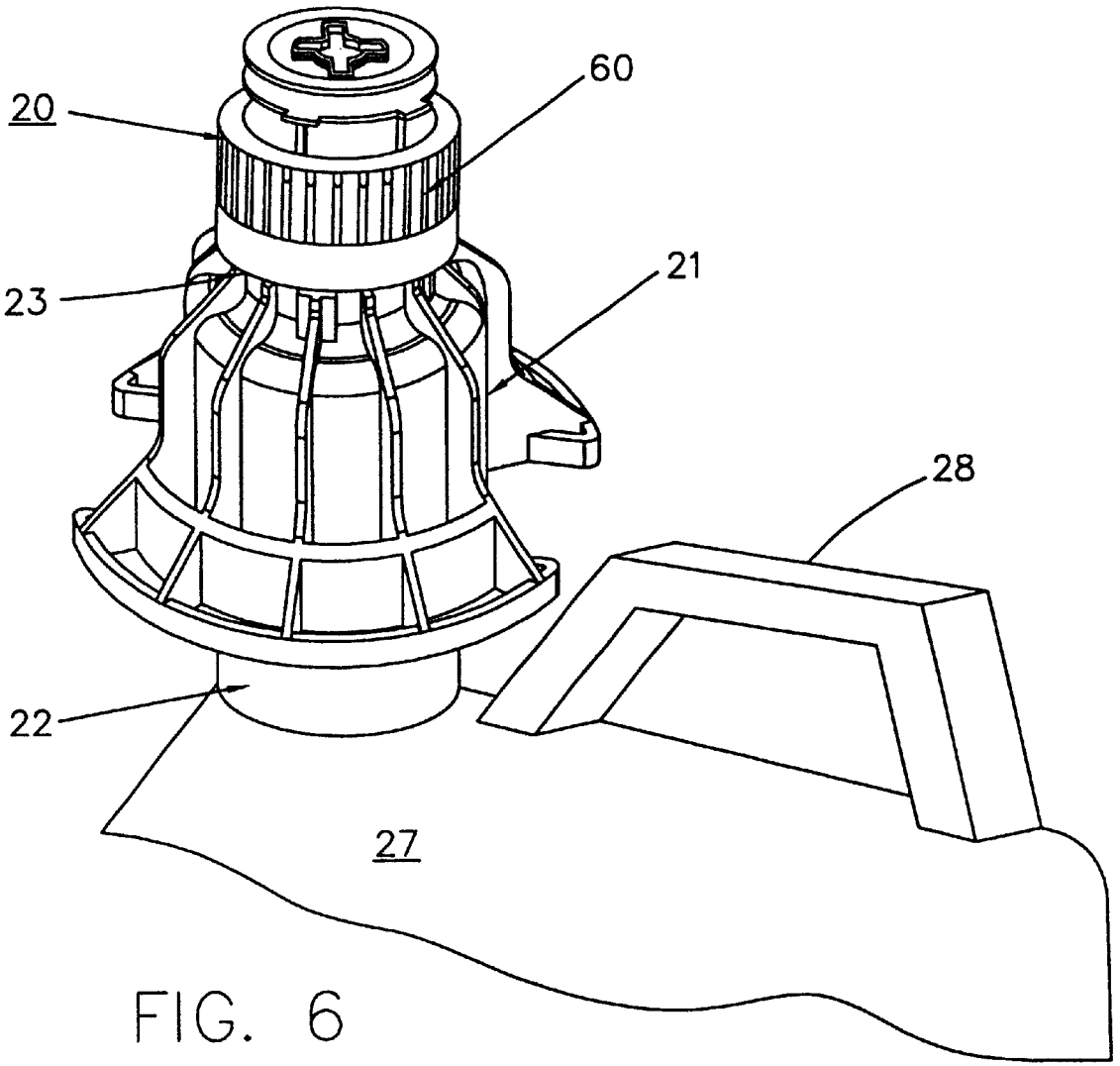
FIG. 6 is a perspective view of the adapter mounted to a container in its first position.
Figure 7:
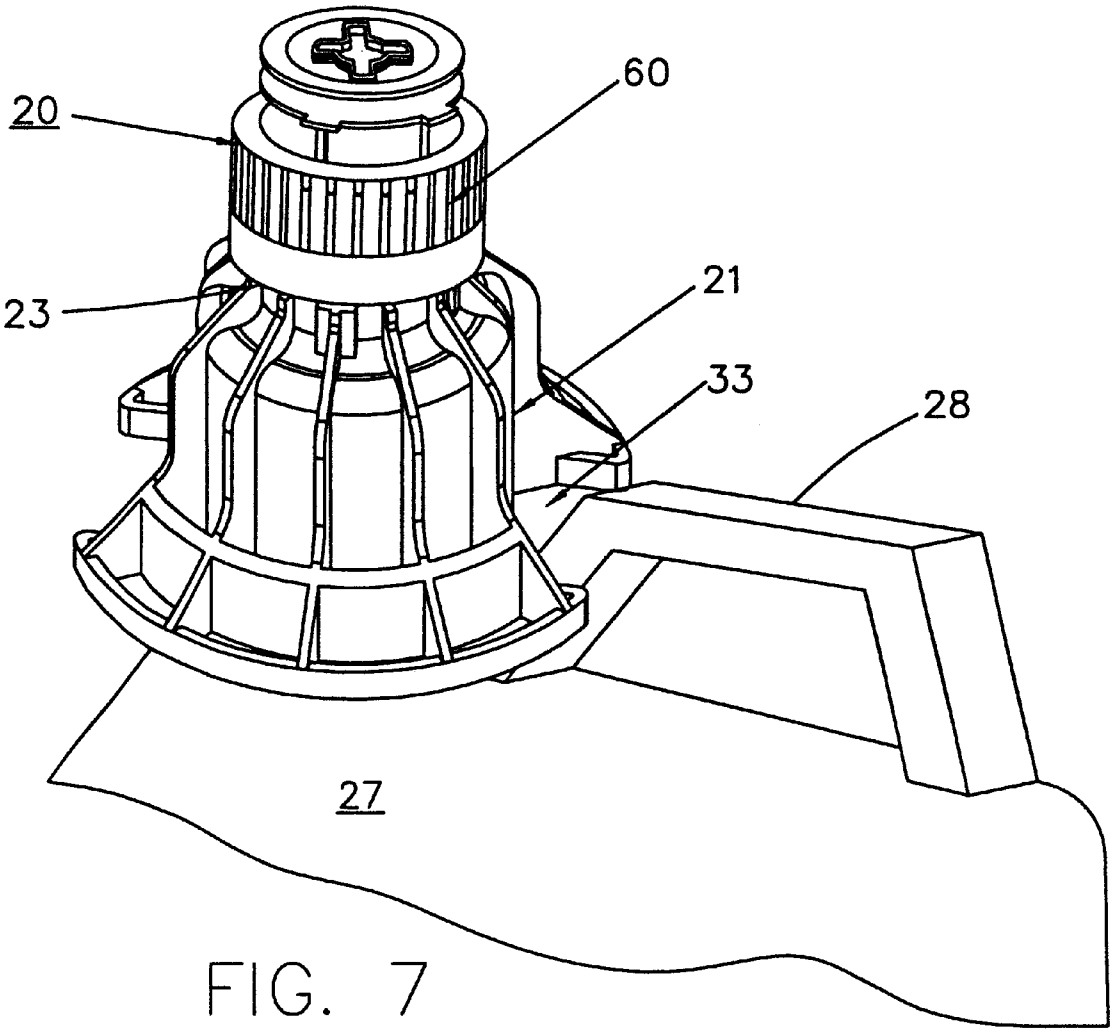
FIG. 7 is a perspective view of the adapter mounted to a container in locked engagement therewith.
Figure 8:
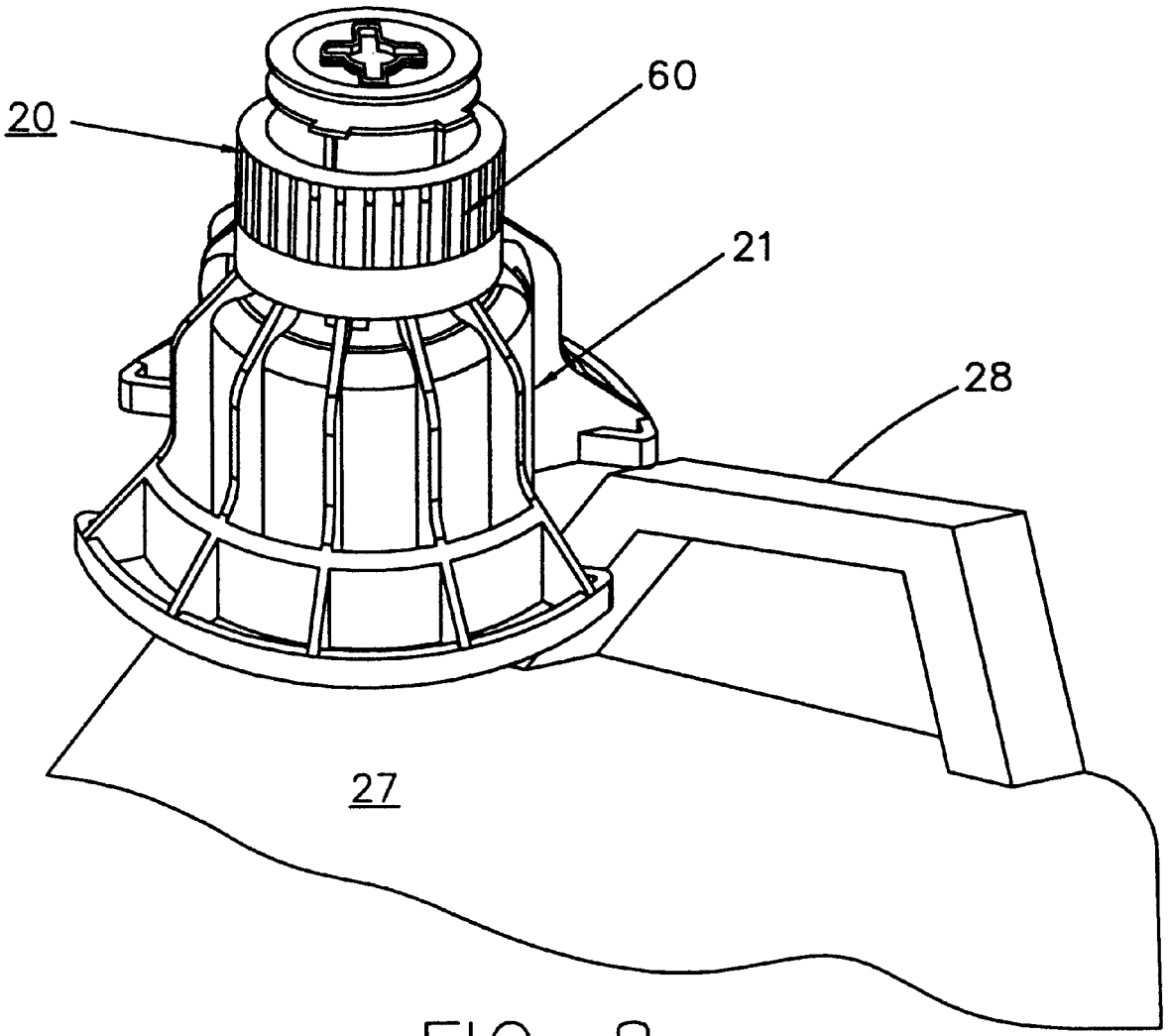
FIG. 8 is a perspective view of the adapter mounted to the container after breaking the container seal for enabling the product stored therein to be dispensed.

In this embodiment, housing 21 comprises an overall size and shape for cooperative, mounted, secure engagement with product bearing container 27, shown in FIGS. 6–8. As depicted, housing 21 comprises a generally bell-shape which incorporates a generally circular-shaped upper portal 29 formed by wall 30 and a generally circular shaped lower portal 31 formed by wall 32.

In addition, housing 21 comprises notches or recessed zones 33 formed in the base thereof for cooperating with handle 28 forming a part of container 27. As detailed below, notches 33 are preferably formed on housing 21 diametrically opposed from each other and dimensioned for being lockingly engaged with handle 28 of container 27 when desired by the user. Housing 21 also comprises a generally U-shaped cut-out zone 34 formed in wall 30 and dimensioned for cooperating receipt of water delivery conduit 24.

As is more fully detailed below, upper portal defining wall 30 is dimensioned for cooperative sliding engagement with tube 23. In addition, a plurality of channels 35 are formed in wall 30 for cooperating with elongated raised ledges 36 formed on tube 23. As shown in the drawings, channels 35 and ledges 36 extend axially along the surface on which they are formed and are substantially equidistant from each other.

Figure 2:
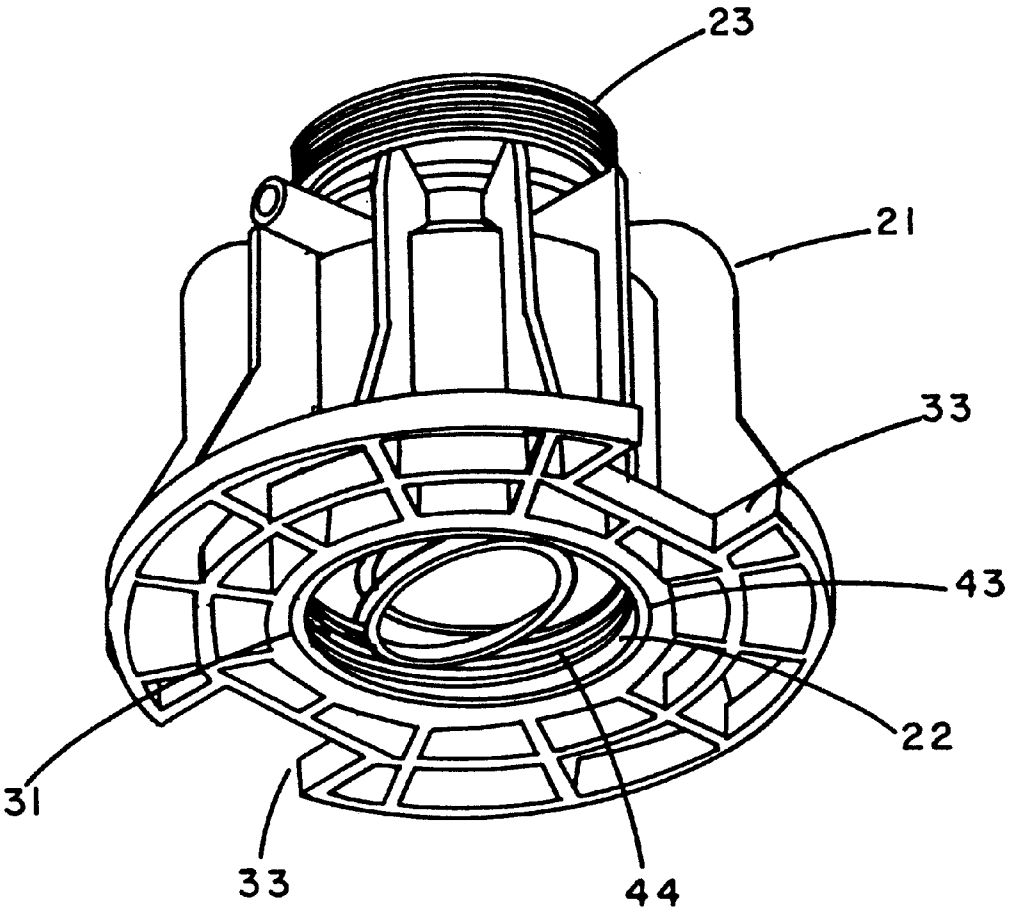
FIG. 2 is a bottom perspective view of the adapter of FIG. 1 depicted fully assembled.

As best seen in FIGS. 1 and 2, collar 22 comprises a substantially cylindrical shape defined by outer wall 40 and inner wall 41. Inner wall 41 is dimensioned for receiving and being slidingly engaged with tube 23, while outer wall 40 is constructed for cooperative engagement with lower portal 31 of housing 21. In this regard, a major portion of outer wall 40 comprises a plurality of axially extending, elongated, raised ribs 42 radially extending outwardly and formed for cooperative sliding engagement with recesses 43 formed in wall 32 of housing 21.

In addition, inner wall 41 of collar 22 comprises thread means 44 formed in the lower end thereof. Thread means 44 are constructed for mating, threaded engagement with the threaded portal of container 27.

If desired, ribs 42 of collar 22 could extend the entire length of wall 40. However, in the preferred embodiment, the lower portion of wall 40 comprises a generally smooth surface. As is more fully detailed below, the engagement of ribs 42 of collar 22 with recesses 43 of housing 21 assures that arcuate rotational movement of housing 21 causes collar 22 to arcuately rotate simultaneously therewith. As a result, adapter 20 is quickly and easily mountable to container 27 by aligning thread means 44 of collar 22 with the threads of container 27, and then rotating housing 21, causing collar 22 to rotate therewith into threaded engagement with container 27.

The final major component of adapter 20 is elongated, cylindrically shaped tube 23. In its preferred construction, tube 23 comprises and upper terminating end 50, a lower terminating end 51, an outer wall 52, and an inner wall 53. Upper terminating end 50 comprises a threaded zone 54 formed in outer wall 52 directly adjacent end 50. As detailed below, threaded zone 54 is constructed for mating interengagement with a valve assembly which is securely affixed to tube 23. Furthermore, the outer diameter of threaded zone 54 is preferably greater than the diameter of outer wall 52.

In addition, lower end 51 of tube 23 is constructed in a manner which causes end 51 to comprise seal cutting means as an integral part thereof. In the preferred embodiment, the cutting means of end 51 is created by forming end 51 with a steep, sloping angle, so that the lowermost portion of end 51 is brought into contact with the seal of the container and cuts the seal for opening the container. Although this construction is preferred, numerous alternate constructions or configurations can be employed without departing from the scope of this invention.

Outer wall 52 of tube 23 is dimensioned for telescopic, sliding engagement with upper wall 30 of housing 21 as well as inner wall 41 of collar 22. In order to assure that no chemical product is able to flow along outer wall 52 of tube 23, sealing rings 55, typically in the form of O-rings, are mounted about outer wall 52. In addition to providing rings 50, close tolerances are employed to assure sliding engagement, without any unwanted leakage.

Furthermore, a stop ring/sealing ring 56 is also employed which is mounted in groove 57 of tube 23. Groove 57 is formed in outer wall 53 adjacent end 51 for sealing engagement with the container portal. In addition, as detailed below, stop/seal ring 56 limits the axial travel of tube 23 within collar 22.

Figure 3:
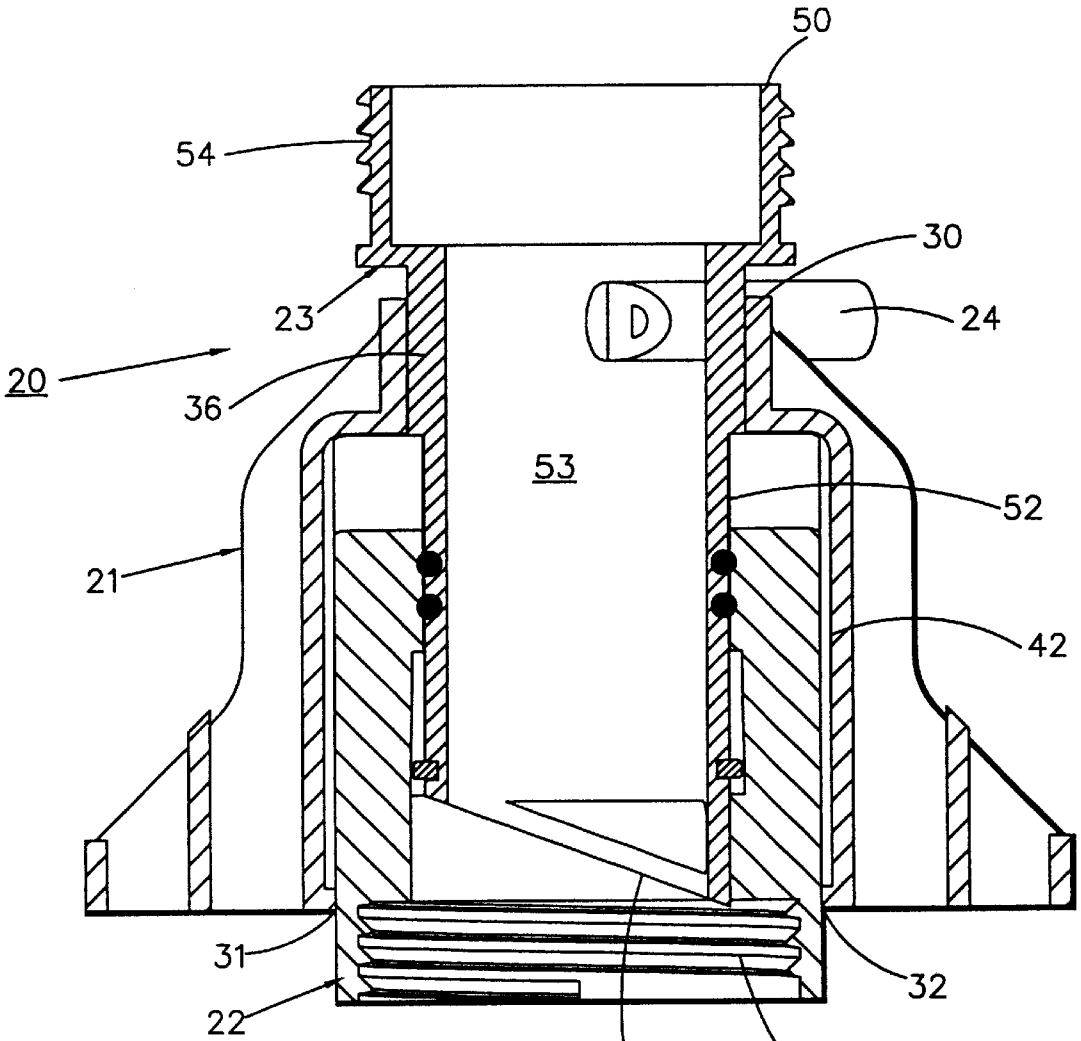
FIG. 3 is a cross-sectional side elevation view of the adapter of FIG. 2 depicted in position for being mounted to a container.

By referring to FIGS. 3–8, along with the following detailed discussion, the overall operation and the ease of opening sealed container 27 using adapter 20 of the present invention can best be understood. In FIG. 3, a cross-sectional side elevation view of adapter 20 is depicted with adapter 20 in position for being mounted to container 27. In FIG. 6, a similar, corresponding associated view is provided wherein adapter 20 is shown mounted to the threaded portal of container 27.

In addition, in FIG. 6, as well as in FIGS. 7 and 8, adapter 20 is depicted with valve assembly 60 mounted to threaded zone 54 of cylindrical tube 23. As detailed herein, in order to provide the desired controlled, closed-loop, spill-free transfer of chemical products from container 27 to a dilution vessel, a valve assembly, such as valve assembly 60, is employed which requires cooperative interengagement with a receiving coupling mounted to the dilution vessel.

In addition, in the preferred embodiment, valve assembly 60 is normally maintained in a closed position, requiring interengagement with the cooperating coupling to open valve assembly 60 for enabling the chemical product in container 27 to be dispensed therefrom. By employing valve assembly 60 in combination with adapter 20, a delivery system for sealed containers is realized while still assuring a completely closed-loop system for preventing unwanted spillage of the chemical product.

Although any desired valve assembly 60 may be employed using the teaching of the present invention, the preferred construction for valve assembly 60 is taught in U.S. Pat. No. 5,960,840. By employing the valve assembly defined therein, all of the attributes for attaining a completely closed loop, spill-free delivery or distribution system are realized and all of the goals inherent in both assemblies are attained.

As shown in FIGS. 3 and 6, in this initial position, collar 22 extends outwardly from the base of housing 21 enabling threads 44 of collar 22 to be easily mounted to the threaded portal of container 27 in secure interengagement therewith. In order to easily effectuate the threaded interengagement of collar 22 with container 27, collar 22 preferably extends outwardly from housing 21 a sufficient distance to assure that raised ribs 42 of collar 22 are mounted in recesses 43 of housing 21. In this way, adapter 20 is easily mounted to container 27 by merely rotating housing 21 after threaded zone 44 is aligned with the threaded portal of container 27. Since housing 21 is controllably engaged with collar 22, the rotation of housing 21 simultaneously causes collar 22 to rotate therewith.

Figure 4:
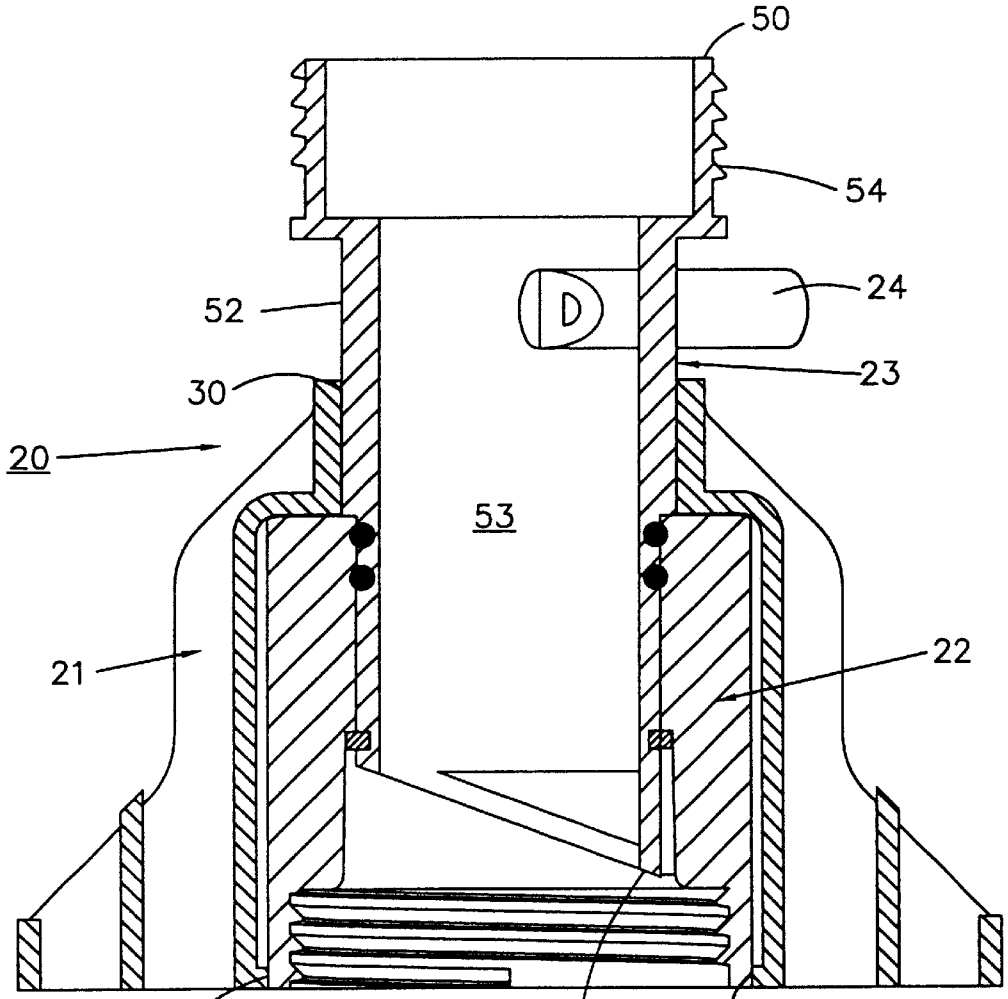
FIG. 4 is a cross-sectional side elevation view of the adapter of FIG. 3 depicted in position for being securely locked to the container.
Figure 5:
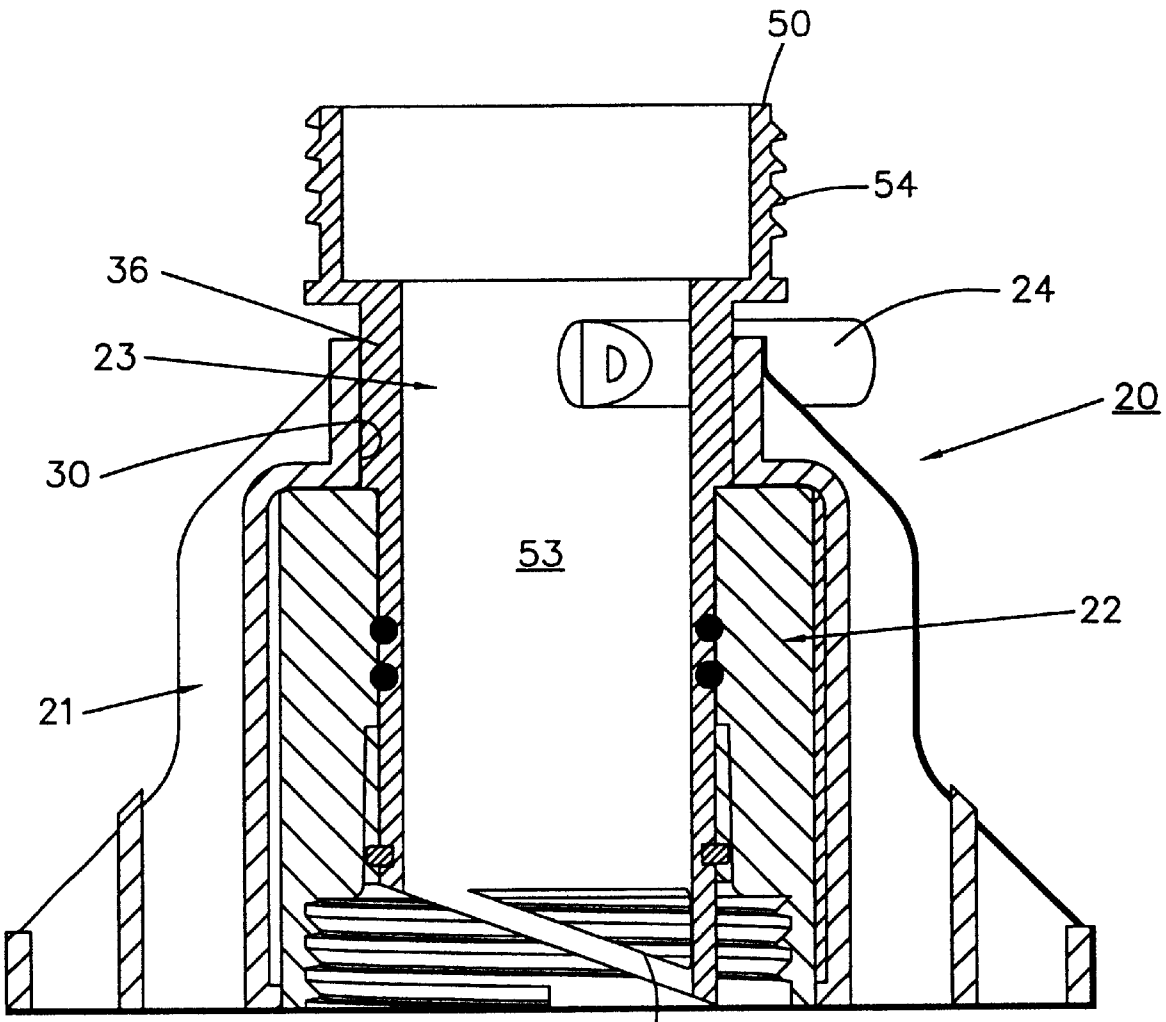
FIG. 5 is a cross-sectional side elevation view of the adapter of FIG. 3 depicted in position for breaking the seal of the container.

Once adapter 20 is securely threadedly engaged with container 27, the next step is to securely interlock adapter 20 with container 27. This step, as depicted in FIGS. 4 and 7, is easily achieved by merely moving housing 21 downwardly relative to collar 22 until collar 22 is completely retained within the interior cavity of housing 21. When in this position, locking notch 33 is moved into juxtaposed, cooperating, engaged relationship with handle 28 of container 27, preventing housing 21 from being arcuately rotated relative to container 27. As a result, adapter 20 is securely lockingly engaged with container 27.

In the final step, prior to dispensing the chemical product from container 27, the seal member which closes container 27 is broken. In order to achieve this result, tube 23 is telescopically moved downwardly relative to housing 21 and collar 22. As clearly depicted in FIGS. 4 and 5, lower cutting edge 51 of tube 23 is in juxtaposed, spaced relationship to the top surface of the seal means of container 27 when adapter 20 is securely locked in place to container 27. However, when tube 23 is telescopically advanced downwardly relative to housing 21 and collar 22, cutting edge 51 is brought into severing contact with the seal of container 27, causing the seal to be broken for enabling the chemical product contain therein to be dispensed through the portal of container 27.

Figure 9:
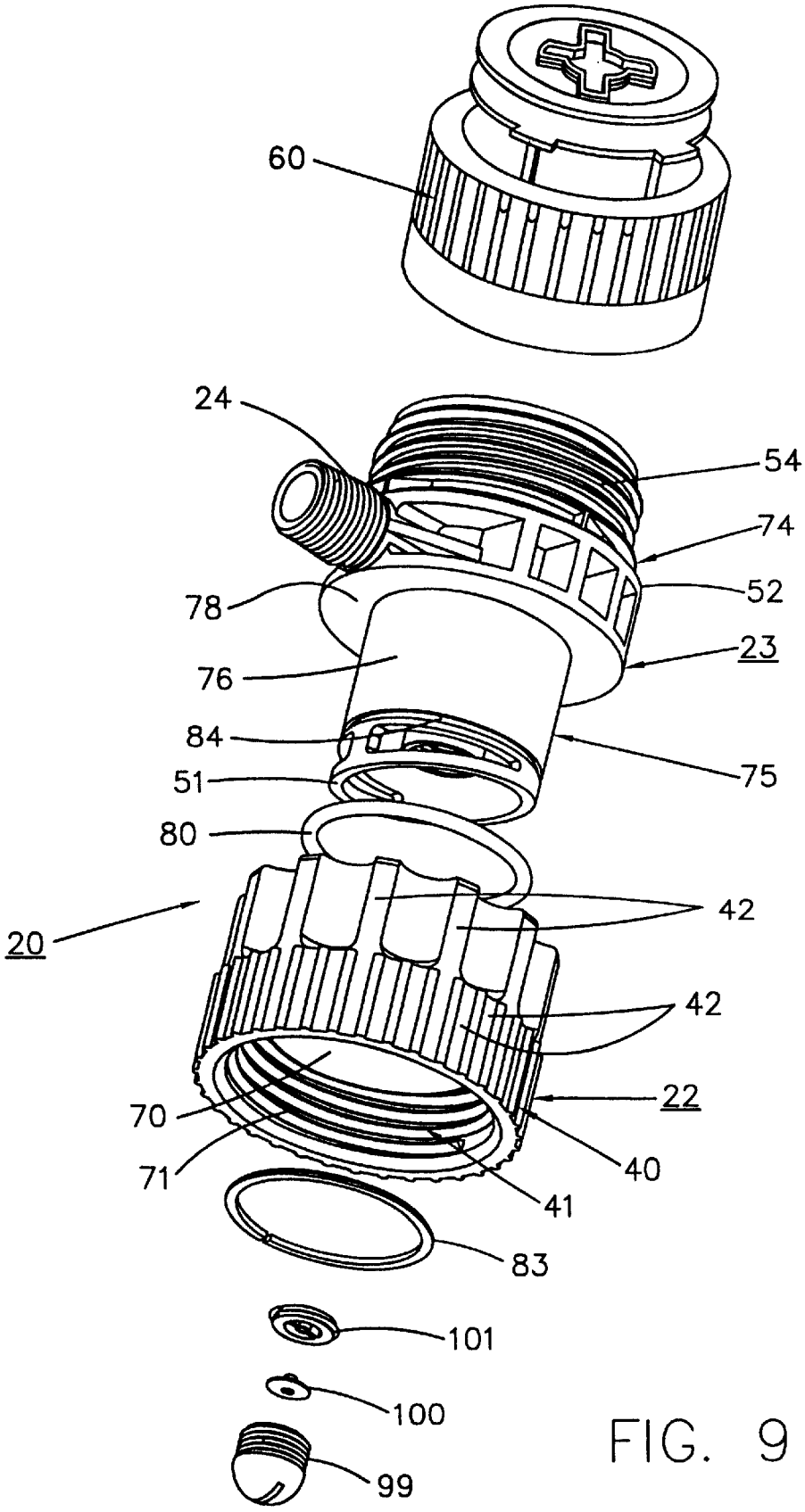
FIG. 9 is an exploded perspective view of another embodiment of the adapter and dispensing system of the present invention.
Figure 10:
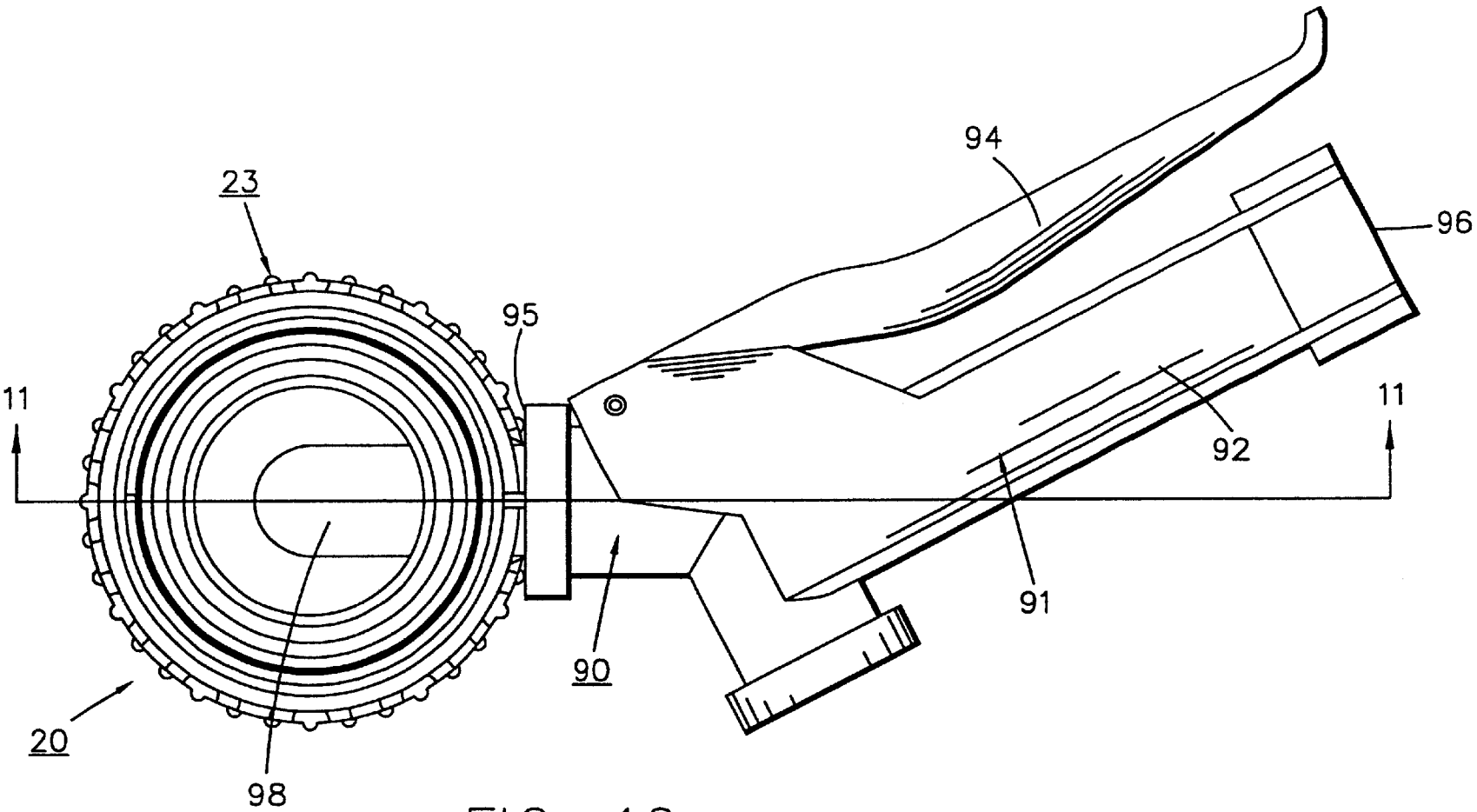
FIG. 10 is a top plan view of the fully assembled adapter of FIG. 9.
Figure 11:
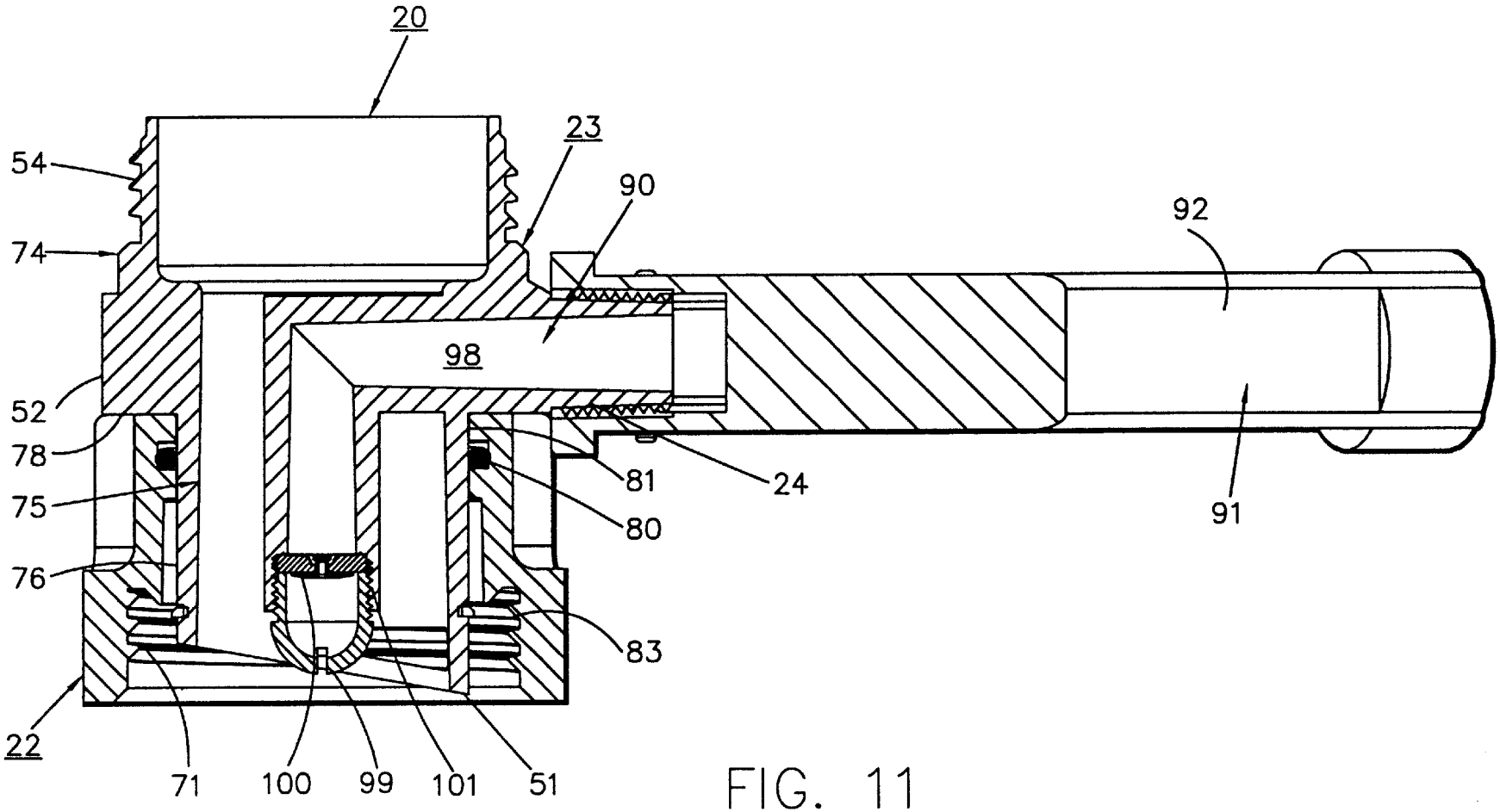
FIG. 11 is a cross-sectional side elevation view of the adapter, taken along line 11—11 of FIG. 10.

In FIGS. 9–11, the overall construction of a second preferred embodiment of adapter 20 of the present invention is fully depicted. In this embodiment, adapter 20 comprises collar 22, and elongated, generally cylindrically shaped tube member 23. In addition, adapter 20 also comprises water delivery conduit 24 which is preferably formed as an integral portion of tube member 23 and is constructed for delivering water into the interior of tube member 23 for enabling any container mounted therewith to be quickly and easily rinsed clean prior to disposal of the empty container.

As discussed above, valve member 60 is preferably secured to tube member 23, as shown in FIG. 9. In this way, complete control over the dispensing of the product retained in the container is assured. In addition, by employing the specially constructed valve member 60, detailed above, a completely closed, spill-free dispensing system is attained.

In addition, as previously discussed, tube member 23 is preferably cylindrical in shape, either wholly or partly. However, any other cross-sectional shape may be employed without departing from the scope of this invention.

In the preferred construction of this embodiment of the present invention, collar 22 comprises a substantially cylindrical shape defined by outer wall 40 and inner wall 41. Inner wall 41 comprises an upper portion 70 and a lower portion 71. In this embodiment, upper portion 70 is dimensioned for receiving and being slidingly engaged with tube member 23, while lower portion 71 comprises thread means 44 formed therein for mating, threaded engagement with the threaded portal of container 27.

Outer wall 40 of collar 22 may comprise any desired surface treatment. However, in order to enable collar 22 to be easily threadedly mounted to container 27, outer surface 40 preferably comprises a plurality of axially extending raised ribs 42 radially extending outwardly from the surface thereof. As depicted, ribs 42 are formed with different spacing on the upper and lower portions of outer wall 40. However, this configuration is optional and any desired spacing or configuration may be employed.

In this embodiment of adapter 20, the second and final component is tube member 23. In its preferred construction, tube member 23 comprises an upper portion 74 and a lower portion 75, with upper portion 74 comprising an outer wall 42, an inner wall 53, a threaded zone 54 formed in wall 52 and terminating with upper end 50. As previously discussed, threaded zone 54 is constructed for mating, secure, interengagement with valve assembly 60 to provide secure affixation of valve member 60 to tube member 23.

Lower portion 75 of tube member 23 comprises a cylindrical shape which is dimensioned for mating, telescopic, longitudinal sliding engagement relative to upper portion 70 of collar 22. In the preferred construction, lower portion 75 comprises an outer surface 76 which terminates with seal cutting end 51 which is formed as an integral portion thereof.

Preferably cutting end 51 is constructed by forming end 51 with a steep, sloping angle which enables the lowermost portion of end 51 to be brought into contact with the seal of the container and cut the seal for opening the container. Although this construction is preferred, numerous alternate constructions or configurations can be employed without departing from the scope of this invention.

In this embodiment of the present invention, tube member 23 comprises a radially extending ledge 78 formed at the juncture between upper portion 74 and lower portion 75. In the preferred construction, ledge 78 comprises a diameter greater than lower portion 75, thereby providing a positive abutment stop for the telescopic, axial movement of tube member 23 relative to collar 22.

As clearly shown in FIG. 11, ledge 78 contacts the top surface of collar 22 to prevent any further telescopic movement of tube member 23. In this way, the precisely desired travel distance of tube member 23 is controlled, assuring complete cutting of the seal by cutting end 51.

In order to assure that no chemical product is able to flow between upper portion 70 of collar 23 and lower portion 75 of tube member 23, a sealing ring 80, typically in the form of an O-ring, is mounted in groove 81 formed in upper portion 70 of inner wall 41, as shown in FIG. 11. In addition to providing sealing ring 80, close tolerances are employed to assure sliding engagement, without any unwanted leakage.

Furthermore, a stop ring/sealing ring 83 is also employed which is mounted in groove 84 of tube 23. Groove 84 is formed in outer wall 76 adjacent end 51 for sealing engagement with the container portal. In addition, stop/seal ring 83 limits the axial travel of tube 23 within collar 22.

As is apparent from the preceding detailed discussion, adapter 20 of the present invention is quickly and easily mounted to container 27, which incorporates a sealed portal, and is quickly and easily securely locked to container 27 and activated for severing the seal covering the portal for enabling the chemical product stored therein to be dispensed. In addition, by securely affixing a valve assembly to adapter 20 which is constructed for preventing unwanted transfer of the chemical products from the container unless mounted to authorized equipment, a complete dispensing system is realized which is capable of eliminating unwanted spillage while providing completely controlled transfer of chemical products between authorized equipment by authorized individuals.

Another feature incorporated into this embodiment of the present invention is water control and spray delivery system 90. By referring to FIGS. 9–11, along with the following detailed discussion, the construction and the operation of water control and spray delivery system 90 can best be understood.

One principal component incorporated in water control and spray delivery system 90 is trigger assembly 91. Although trigger assembly 91 may comprise numerous alternate configurations, the preferred embodiment comprises a single assembly incorporating housing 92 and activation lever 94. Activation lever 94 is pivotally mounted to housing 92 and is employed for starting and stopping the flow of water through housing 92. In addition, housing 92 incorporates two opposed ends 95 and 96, both of which are preferably constructed with a thread zone formed therein for ease of mounting to the desired cooperating components.

In this regard, end 96 of housing 92 is constructed for being threadedly engaged with a water delivery conduit or tube in order to assure that the desired water source is available to water control and spray delivery system 90. In addition, threaded end 95 of housing 92 is constructed for mating, threaded interengagement with water delivery conduit 24 extending from tube member 23. As clearly depicted in FIG. 9, water delivery conduit 94 incorporates threads formed in the outer surface thereof in order to enable end 95 of housing 92 to be quickly and easily securely affixed thereto for delivering water to tube member 23.

In this embodiment of the present invention, water control and spray delivery system 90 also comprises a delivery conduit or flow path 98 formed in tube member 23. As depicted, in the preferred construction, delivery conduit or flow path 98 is preferably formed in a substantially L-shape, extending from water delivery conduit 24 and terminating along the central axis of tube member 23.

By employing this construction, water flow is delivered through the side wall of tube member 23 and controllably channeled to exit along the central axis of tube member 23, as well as collar 22 whenever collar 22 is mounted to tube member 23. As a result, this construction provides the precisely desired configuration for assuring complete, controlled, rinse water spray delivery to the product bearing container mounted to collar 22.

In order to further enhance and provide optimum rinsing of the container mounted to collar 22, water control and spray delivery system 90 also incorporates, in the preferred construction, a nozzle head 99 mounted to the terminating end of delivery conduit and flow path 98. Furthermore, in the preferred construction, nozzle head 99 cooperates with a general conventionally constructed umbrella-shaped spray former 100 and cooperating disc 101.

By employing this construction, water control and spray delivery system 90 provides the precisely desired rinsing water spray delivery, with the spray exiting from nozzle 99 in the optimum position, direction and pattern, directly at the entry portal of the product container. As a result, once the product retained in the container has been dispensed therefrom, a water delivery conduit is quickly mounted to housing 92 of trigger assembly 91 for providing the desired water flow.

By activating lever 94, whenever desired, the flow of water is provided directly through delivery conduit and flow path 98 exiting from nozzle 99. With the exiting spray positioned in the optimum location, complete cleaning of the container is realized with the water being easily poured through adapter 20 into a receiving vessel, or other location, as desired by the user. Once fully rinsed, the container is clean and devoid of any toxic product, thereby allowing the container to be dispensed in any manner desired.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An adapter constructed for cooperating with a valve member and for being mounted to a sealed product retaining container to open the seal and enable the product to be dispensed in a closed, spill-free manner, said adapter comprising:

A. a collar constructed for being securely mounted to the product bearing container in peripheral, surrounding engagement with a portal of the container; and B. an elongated tube member cooperatively associated with the collar for telescopic, axial movement relative thereto, said tube member incorporating:

a. a valve receiving zone formed at a first end thereof for receiving and securely retaining a cooperating a valve member, b. seal cutting means formed at a second end thereof, positioned for contacting, cutting engagement with the seal of the container whenever said tube member is axially moved relative to the collar, and C. a water control and spray delivery system for enabling rinse water to be controllably delivered directly to the container for cleaning the container after use;

whereby a dispensing system is obtained which assures that the sealed product retaining containers are quickly and easily opened, when desired, with the product retained therein being dispensed in a completely closed, spill-free manner.

2. The adapter defined in claim 1, wherein said water control and spray delivery system is further defined as comprising a water delivery conduit and flow path integrally formed in the tube member and constructed for receiving water flow from an external source and delivering the water directly to the interior of the tube member.

3. The adapter defined in claim 2, wherein said water delivery conduit and flow path is further defined as comprising a substantially L-shape, with a first portion thereof substantially aligned with the central axes of the tube member and a second portion thereof extending outwardly from the side wall of the tube member.

4. The adapter defined in claim 3, wherein said water control and spray delivery system comprises a spray delivery nozzle assembly mounted to one terminating end of the delivery conduit and flow path for providing a precisely desired spray pattern for thoroughly rinsing and washing the interior of the container after the product retained therein has been dispensed, thereby enabling a clean container to be recycled in a typical manner.

5. The adapter defined in claim 3, wherein said water control and spray delivery system further comprises a trigger assembly mountable to the second portion of the water delivery conduit and flow path and constructed for controlling the flow of water through said delivery conduit and flow path to assure a free flow of water whenever desired.

6. The adapter defined in claim 5, wherein said trigger assembly is further defined as comprising:

a. a housing securely mountable at a first end thereof to the second portion of the water delivery conduit and flow path and constructed for being securely engagable at a second end thereof to a water source; and b. an activation lever pivotally mounted to the housing and constructed for controlling the flow of water through the housing;

whereby water flow through the system is quickly and easily controlled by the user.

7. The adapter defined in claim 1, wherein the seal cutting means is further defined as comprising a beveled, sloping terminating edge formed along the second end of the tube member and constructed for cutting the seal when moved into engagement therewith.

8. The adapter defined in claim 7, wherein the collar and the elongated tube member are further defined as comprising substantially cylindrical shapes, with the collar peripherally surrounding a portion of the tube member, with the tube member being axially movable relative to the collar.

9. The adapter defined in claim 8, wherein the tube member further comprises a radially extending ledge constructed for abutting, contacting engagement with a surface of the collar for limiting the axial movement of the tube member relative to the collar while assuring breakage of the seal by the seal cutting means.

10. A dispensing system constructed for being mounted to a sealed product retaining container to open the seal and enable the product to be dispensed in a closed, spill-free manner, said dispensing system comprising:

A. a collar constructed for being securely mounted to the product bearing container in peripheral, surrounding engagement with a portal of the container;

B. an elongated tube member cooperatively associated with the collar for telescopic, axial movement relative thereto, said tube member incorporating:

a. a valve receiving zone formed at a first end thereof for receiving and securely retaining a cooperating a valve member, b. seal cutting means formed at a second end thereof, positioned for contacting, cutting engagement with the seal of the container whenever said tube member is axially moved relative to the collar, c. a valve member securely mounted to the valve receiving zone of the tube member and constructed for mating engagement with a cooperating dilution vessel and d. a water control and spray delivery system for enabling rinse water to be controllably delivered directly to the container for cleaning the container after use whereby a dispensing system is obtained which assures that the sealed product retaining containers are quickly and easily opened, when desired, with the product retained therein being dispensed in a completely closed, spill-free manner directly into an appropriate receiving vessel.

11. The dispensing system defined in claim 10, and further comprising:

D. a housing peripherally surrounding and cooperatively associated with the collar and constructed for providing mating engagement with the product retaining container.

12. The dispensing system defined in claim 11, wherein said housing is further defined as being axially movable relative to the collar between a first container disengaged position and a second container engaged position.

13. The dispensing system defined in claim 12, wherein the product retaining container is further defined as comprising a handle member and said housing is further defined as comprising notches formed therein constructed for mating locking engagement with the handle of the container when said housing is moved into its second container engaged position.

14. The dispensing system defined in claim 12, and further comprising movement control means constructed for preventing axial movement of the tube member relative to the collar prior to locking engagement of the housing with the container.

* * * * *